US007178790B2

(12) United States Patent
de Lorenzo

(10) Patent No.: US 7,178,790 B2
(45) Date of Patent: Feb. 20, 2007

(54) CONSTRUCTIVE ARRANGEMENT FEATURE IMPROVEMENT INTRODUCED IN POLES FOR THE ORGANIZATION OF LINES

(76) Inventor: Ricardo Augusto de Lorenzo, Av, Eliseu de Almeida, 1103, Sao Paulo, Sao Paulo (BR)

( * ) Notice: Subject to any disclaimer, the term of this patent is extended or adjusted under 35 U.S.C. 154(b) by 88 days.

(21) Appl. No.: 10/886,977

(22) Filed: Jul. 8, 2004

(65) Prior Publication Data

US 2005/0017115 A1 Jan. 27, 2005

(51) Int. Cl.
*E04H 17/14* (2006.01)

(52) U.S. Cl. ..... 256/59; 256/1; 256/32; 256/65.11; 49/34; 160/24; 160/241

(58) Field of Classification Search ..... 256/1, 256/24, 32, 45, 59, 65.11; 160/24, 120, 241; 49/34

See application file for complete search history.

(56) References Cited

U.S. PATENT DOCUMENTS 4,119,301 A * 10/1978 Payne ..... 256/1
6,375,164 B1 * 4/2002 Siegler et al. ..... 256/24
6,830,236 B2 * 12/2004 Augusto de Lorenzo ..... 256/1

* cited by examiner

*Primary Examiner*—Daniel P. Stodola
*Assistant Examiner*—Michael P. Ferguson
(74) *Attorney, Agent, or Firm*—McCormick, Paulding & Huber LLP

(57) ABSTRACT

A stanchion has three tapes arranged in spaced relation along the upstanding post for controlling pedestrian traffic. Each stanchion/post has four guide grooves that extend the entire length of the post. Each stanchion is of annular cross section having an inner or inside surface adapted to receive a cylindrical spool around which is wound the individual tape or line. The free end of each tape has a locking element of triangular configuration adapted to be received in the guide groove of an adjacent post. The spools serve to retract each tape so as to provide continuous tension in the tape that is deployed or extended between its associated stanchion and another such post or stanchion. Each tape extends through a rectangular slot provided for this purpose at vertically spaced locations along the post/stanchion. Corresponding locations in the adjacent guide grooves of each post are provided with fittings that form stops for tapes from other stanchions.

3 Claims, 4 Drawing Sheets

CONSTRUCTIVE ARRANGEMENT FEATURE IMPROVEMENT INTRODUCED IN POLES FOR THE ORGANIZATION OF LINES

CROSS REFERENCE TO RELATED APPLICATIONS

This utility application incorporates by reference and claims priority to a prior Brazilian patent application filed on Jul. 8, 2003, assigned Serial No. MU 8301203-6.

APPLICATION OF THE INVENTIVE IMPROVEMENT

This improvement in the constructive arrangement feature, or more particularly the utility model herein disclosed, contains therein and shows technical improvements, aiming the characterization of functional and operational enhancements in poles with belts for the organization of lines or the establishment of perimeters in predetermined areas or spots.

FIELD OD APPLICATION

The present improvement in the constructive arrangement feature of the utility model herein disclosed is related to constructive enhancements applied to the assembling of the internal components of the belts and the reels, making possible the utilization of two, three or more reels of belts in a single pole.

Said pole, which is provided with belts for the orientation and the organization of lines and/or the establishment of perimeters in predetermined areas as events, banks, trade fairs, public bureaus, hotels, airports, etc.

STATE OF ART

In general it is widely known that for the organization of lines in diversified places or spots like: paying counters, banking counters; selling counters, check-in counters, etc., in general the line's organization is easily obtained using the well known in the art pole with belt.

Said pole, generally is produced of a wide range of materials as high resistance polymers, although in their majority they are made of aluminum, more precisely, making reference to extruded profiles, bearing an specific and characteristic shape, said pole shape allowing therein the assembling of an internal mechanism.

Said internal mechanism, constructed in the form of a reel where such reel is provided with a belt, and where such belt is provided with a wind-back system.

Said belt can be wound-forward out of the internal mechanism up to a determined length, and at such belt's end it is provided with a coupling element that can be coupled to other similar pole with a similar extruded profile, which bears the same specific and characteristic shape.

This way, according to the characteristics and features exposed above, multiple diversified forms and ways of assembling and installation of said internal mechanism, constructed in the form of a reel placed inside the so called poles for the organization of lines and/or establishment of perimeters in predetermined areas are already in the market.

Furthermore, depending on the perimeter to be organized, said poles for the organization of lines and/or establishment of perimeters in predetermined areas are demanded to have more than one belt reel, which can be either for an aesthetic pattern purpose or to avoid undesirable accesses to the formed lines over a path different from those which were predetermined.

Therefore, multiple different means to place such reels of belts inside the inner portion of said profiles were developed, and in general one reel is the most common feature and two reels is the maximum amount of belt's reels currently placed inside the inner portion of said profiles, which has been available in the market in the last years.

Anyway, the assembling and installation of said more than one reel of belts inside the inner portion of said poles profiles demands a greater number of parts and components for the proper reels of belts installation and functioning.

Since viability of said two reels of belts poles profiles demands a larger number of fixation parts like fixtures and locks, their costs become to high when compared to those single belt's reel poles profiles.

Such increase of parts and components for the proper reels of belts installation and functioning results in great inconvenience for the poles manufacturers as well as for the poles final users.

The poles manufacturers must reorganize their lines to manage innumerous new production steps like: an increased purchase of raw materials, an increased manufacturing and purchase of parts and components, the insertion of a number of new operations during the manufacturing process, much more items to be under quality control/process control, and etc., what fatally shall result in a longer manufacturing time and consequently in a higher cost. The final users by their turn shall be the ones to pay for such cost increase.

Nowadays there are some poles having two reels of belts where one reel of belt is assembled on the upper portion of the pole profile and the other reel of belt is assembled close to the bottom portion of the pole profile.

Nevertheless, for the said reel of belt to be assembled, it shall be leaned on a bracket mounted inside the inner portion of the pole profile, what makes its costs overwhelmingly high when compared to the ordinary single belt reel pole.

Furthermore the embodiment above cited restricts as well as makes impossible the assembling of a pole profile having more than two belts reels, limiting, this way the poles profiles with belts for the organization of lines and/or establishment of perimeters in predetermined areas or spots.

OBJECTIVES OF THE INVENTIVE IMPROVEMENT

In consideration to the above-mentioned circumstances the present constructive arrangement feature improvement introduced in poles for the organization of lines was developed aiming in its generality to present an assembling of reels of belts inside poles profiles, which don't use integral brackets for their support and fixation.

Another characteristic of the present constructive arrangement feature improvement introduced in poles for the organization of lines lies in the fact of presenting the possibility of assembling two, three or more reels of belts inside one pole profile, said prerogative not available in the ordinary pole profiles of the known art.

Another characteristic of the present constructive arrangement feature improvement introduced in poles for the organization of lines is its easy coupling and easy mounting what provides a low production time, once the whole assembling is performed solely through the parts fitting one to the other and the array being held through bolts.

This way, the present constructive arrangement feature improvement introduced in poles for the organization of lines presents an extruded profile, preferably of a material as aluminum, provided in a specific and characteristic design, which can be presented in multiple different plastic shapes.

Therefore, the present constructive arrangement feature improvement introduced in poles for the organization of lines have its profile designed according to the number of belts that shall be applied to the specific embodiment.

Furthermore, the present constructive arrangement feature improvement introduced in poles for the organization of lines have its profile provided with openings for the passage of the belts solely in one face of the pole profile, while the other faces of said pole profile are solely provided with holes for the assembling of bolts.

BRIEF DESCRIPTION OF THE DRAWINGS

Aiming a better comprehension of the present constructive arrangement feature improvement introduced in poles for the organization of lines, a brief description of the drawings that come along with this utility model can be fin below.

DETAILED DESCRIPTION OF THE PREFERRED EMBODIMENT

Figure 1:
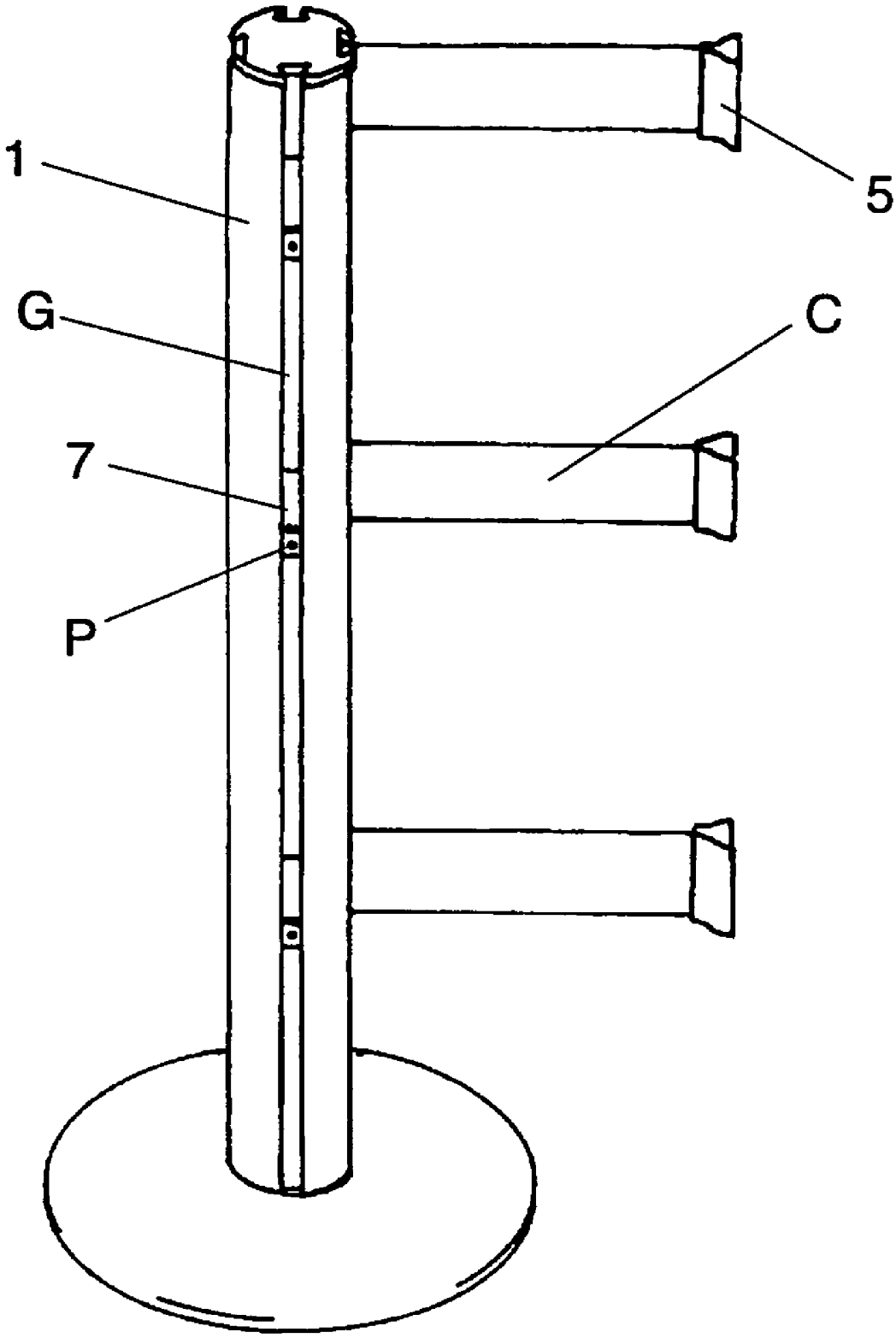
FIG. 1—Represents a perspective view of the pole profile of the present utility model assembled with three belts.
Figure 2:
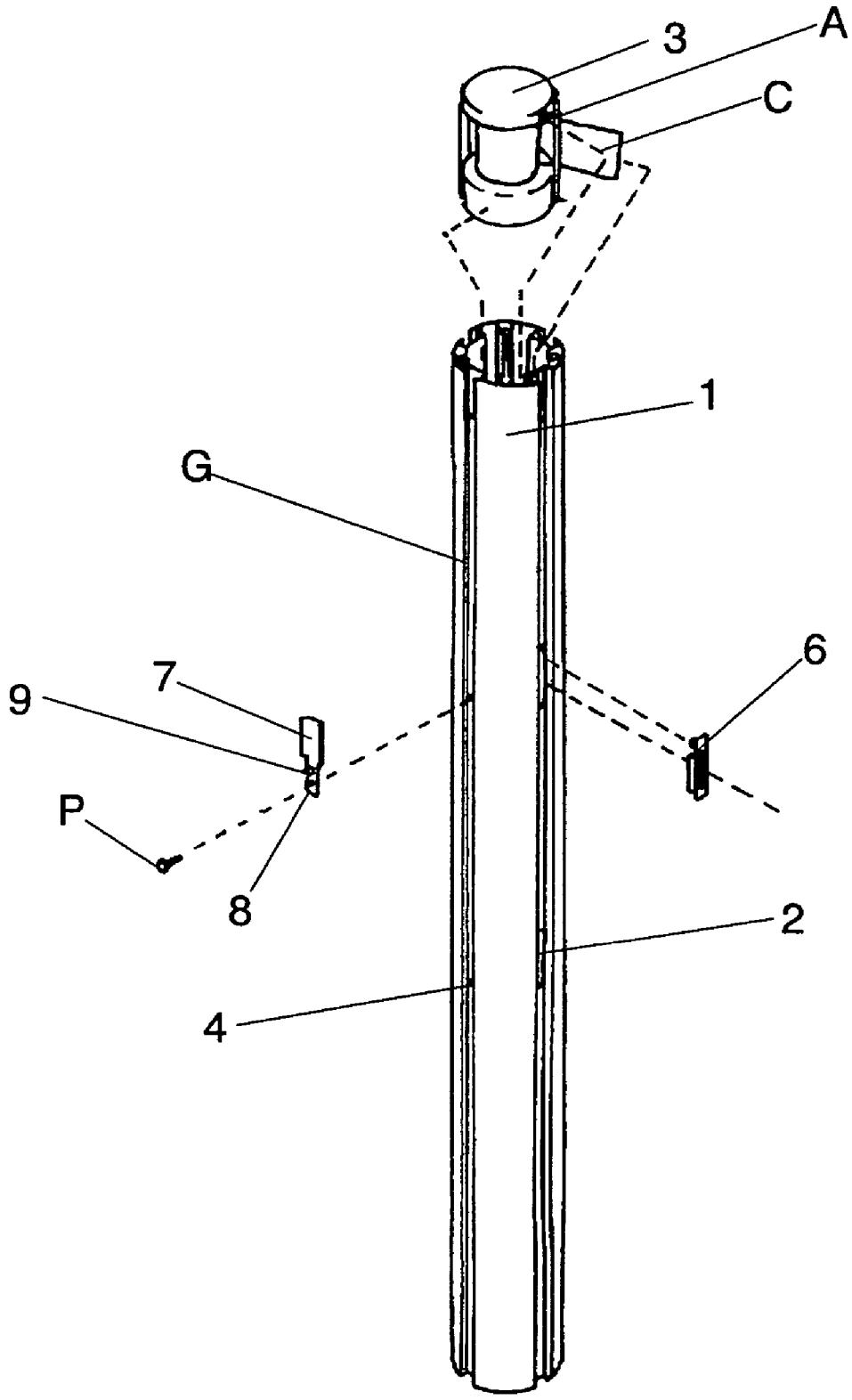
FIG. 2—Represents another perspective view of the pole profile of the present utility model enlarged, illustrating the pole and one reel of belt.
Figure 3:
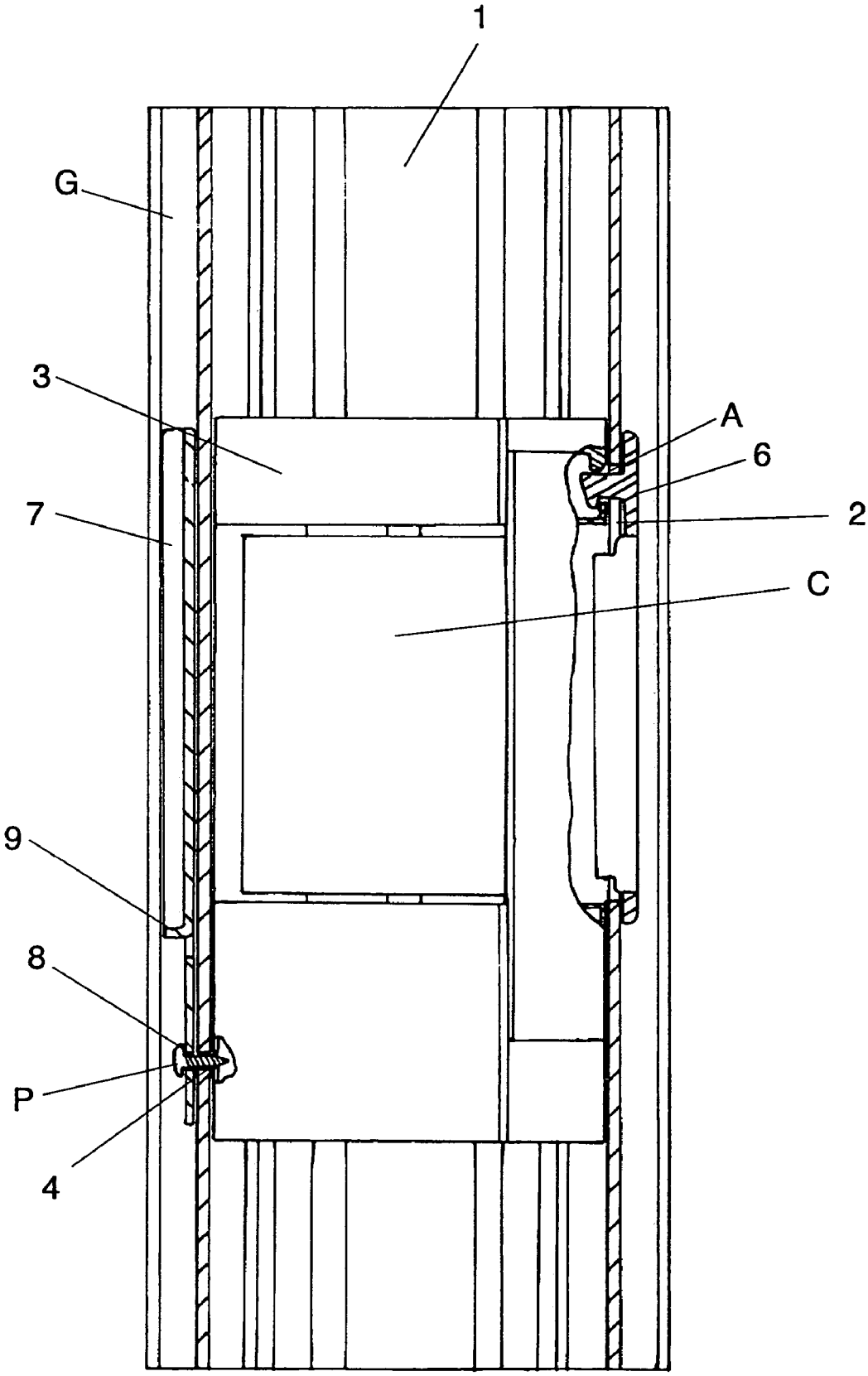
FIG. 3—Represents a side cross section view of the pole profile of the present utility model, illustrating the reel of belt assembling inside its inner portion.
Figure 4:
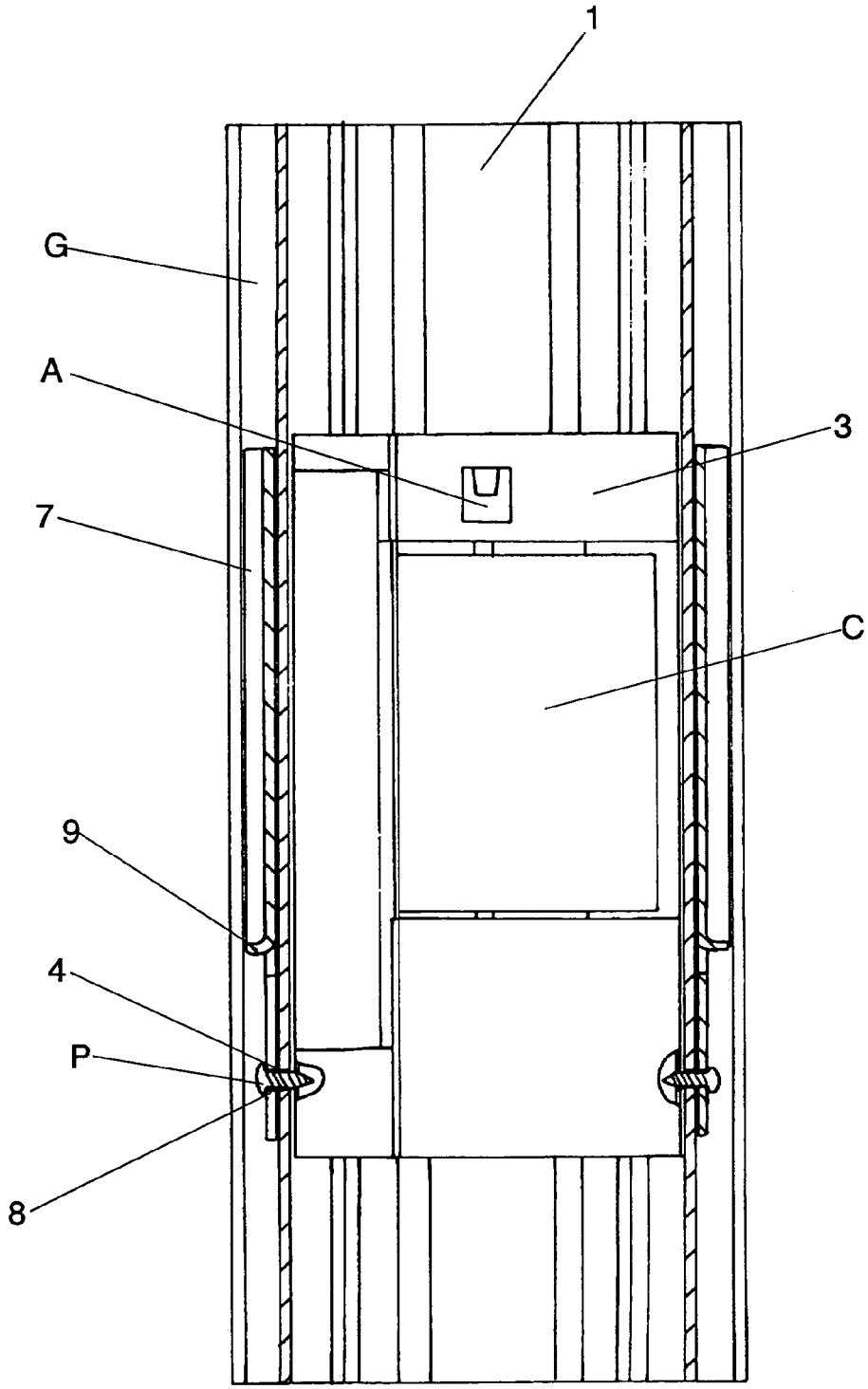
FIG. 4—Represents a side cross section view of the pole profile as shown in FIG. 3 depicting a cut section at the front portion of the pole profile of the present utility model, illustrating the fixation of the reel of belt inside its inner portion.

According to the illustrations provided by the figures above described as well as to the details thereof, the pole profile of the present utility model entitled, "CONSTRUCTIVE ARRANGEMENT FEATURE IMPROVEMENT INTRODUCED IN POLES FOR THE ORGANIZATION OF LINES" is now detailed in its preferred embodiment.

The pole of the present utility model is basically formed by an extruded profile (1), preferably made of a material as aluminum, shaped in a characteristic design with guides (G), which plastic shape may vary, being illustrated one preferred execution embodiment of the same.

Said profile (1) is shaped containing a determined number of rectangular openings (2) in one of its guides (G), according to the number of reels of belts (3) that shall be applied.

It shall be noted that still there are openings (4), which are provided in the others guides (G), to form the coupling spots of the belts locking elements (5).

This way, inside the inner portion of the profile (1) the reels of belts (3) are fitted in a way that they are pushed up to the point they get aligned to the referred rectangular openings (2).

Once the reels of belts (3) are aligned to the rectangular openings (2), this positioning makes possible the passage of the belts (C) that passes through a finishing element (6) made of plastic material that is coupled at the referred rectangular opening (2).

Said finishing element (6) made of plastic material has its upper portion that couples to an opening (A) provided at the upper portion of the referred reel of belt (3).

When the referred reel of belt (3) is correctly placed along with the profile (1), the locking tabs (7) are assembled.

Said the locking tabs (7) are provided with a hole (8) close to their bottom end as well as they have a rectangular cut, configuring a limitation element (9).

Said hole (8) is provided for the insertion of a bolt (P), said bolt that crosses over said hole (8) and crosses over the hole (4), which is also provided in the profile (1).

Said bolt (P) reaches the base of the reel of belt (3) which, once it is made of a plastic material, allows the hole to be made by the fixing movement of the bolt (P) itself, in the moment when the pole is assembled, fixing the reel of belt in a safe and rapid way.

Once the pole is assembled, to be possible for the belts locking elements (5) to fit to the guides (G), it is enough to bend them laterally, making one of their sides to couple to the guide (G) and to fit the other side is enough to slightly press it against the said guide (G).

When the belts locking elements (5) are fit to the guides (G) the array shall be pushed down towards the locking tab (7) up to the point that its movement is restricted by the limitation element (9).

To unlock the array the user shall simply perform the reverse movement.

As it is possible to verify by those skilled in the art after what has been disclosed and illustrated herein, the object of the present utility model entitled "CONSTRUCTIVE ARRANGEMENT FEATURE IMPROVEMENT INTRODUCED IN POLES FOR THE ORGANIZATION OF LINES" fulfills perfectly the requirements which define an Utility Model, once it has combined and modified elements already known in the art, providing to its components a new and different form and disposition, enhancing the present utility model object efficiency, improving the present utility model object performance, decreasing the present utility model manufacturing time, quantity of components and consequently the costs and mainly making the application of the present utility model object much more functional in the utilization by the final consumer.

The invention claimed is:

1. A combination comprising: an axially elongated extruded post having a hollow interior profile and an external profile of uniform cross section, said post having first and second axially elongated grooves opening radially outwardly onto an uninterrupted external profile surface, and said grooves defined by converging groove side walls; at least one reel slidably received inside said hollow post profile; at least one strap guiding device contained within said first groove; a strap opening inside said first groove for running a retractable strap radially outwardly from said reel through said strap opening from said strap guiding device to a groove of an adjacent post; a fastener element in said strap guiding device also inside said first groove for locating the device inside said first groove; and a locking tab in said second groove for engaging said reel at a location spaced from the fastener element in said first groove for anchoring said reel inside said post, said strap guiding device and locking tab contained entirely within said grooves to provide said uninterrupted external profile surface.

2. The combination according to claim 1 further including a second reel provided between the upper and lower ends of the post, said second reel also having an associated second strap opening in said first post groove for receiving a second fastener element and locating said second reel between said second faster element and a second locking tab in said second groove of said post and serving the function of locating said second reel axially in said post, whereby at least two straps can be provided between the top and bottom of the post.

3. The combination according to claim 2 wherein said fastener elements and locking tabs are provided entirely within their respective grooves of the extruded post profile so that the external profile surface is preserved without interruption.

* * * * *